United States Patent [19]

Ono et al.

[11] Patent Number: 4,627,677

[45] Date of Patent: Dec. 9, 1986

[54] FLEXIBLE CURRENT FEEDING POST

[75] Inventors: Izumi Ono, Hachioji; Iwami Manago, Yokohama; Haruo Takayama, Sagamihara; Yasuo Takahashi, Kawasaki, all of Japan

[73] Assignee: Fujitsu Limited, Kawasaki, Japan

[21] Appl. No.: 738,864

[22] Filed: May 29, 1985

[30] Foreign Application Priority Data

May 31, 1984 [JP] Japan ..... 59-111280
Dec. 18, 1984 [JP] Japan ..... 59-192545

[51] Int. Cl.[4] ..... H01R 9/09
[52] U.S. Cl. ..... 339/17 M; 339/9 E
[58] Field of Search ..... 339/1 R, 2 R, 6 R, 4, 339/9 R, 9 E, 17 M, 254 M, 255 R; 361/412, 413; 174/69, 86, 99 E, 12 R, 14

[56] References Cited

U.S. PATENT DOCUMENTS

| | | | |
|---|---|---|---|
| 1,588,556 | 6/1926 | Thompson | 339/222 |
| 2,476,943 | 7/1949 | Brady | 339/9 R |
| 3,065,293 | 11/1962 | Overman | 339/9 E |
| 3,209,305 | 9/1965 | Bruckner et al. | 339/61 C |
| 3,382,414 | 5/1968 | Borner | 361/412 |

FOREIGN PATENT DOCUMENTS

| | | | |
|---|---|---|---|
| 1958109 | 5/1971 | Fed. Rep. of Germany | 174/86 |

*Primary Examiner*—Neil Abrams
*Attorney, Agent, or Firm*—Staas & Halsey

[57] ABSTRACT

A flexible current feeding post for electronic modular assemblies interconnects parallel oriented substrates such as printed circuit boards having electrical circuits mounted thereon and bus plates for power supply, for both mechanical assembly and current distribution. The flexible current feeding post comprises a solid, cylindrical stud for connection to a contact surface of one substrate, a conductive bellows connected to the stud and means connecting the conductive bellows to a contact surface of a second substrate, spaced from the first substrate by a desired distance and generally parallel thereto. The flexible current feeding post affords tolerances with respect to mechanical misalignment of the respective contact surfaces of the interconnected substrates and spacing variations therebetween, thus eliminating undesirable distortion of the interconnected substrates and affording enhanced tolerance to thermal distortions of the substrates during operation, and assuring intimate and uniform connections of the feeding post to the corresponding contact surfaces of the substrates to minimize voltage drops thereacross. Flexible current by-pass means are afforded to increase the current handling capacity of the feeding post.

9 Claims, 8 Drawing Figures

FLEXIBLE CURRENT FEEDING POST

BACKGROUND OF THE INVENTION

1. Field of the Invention

The present invention relates to current feeding posts, also known as conductive mounting posts (hereinafter referred to as "feeding posts") used in electronic apparatus, such as communications equipment and computers, for structurally and electrically interconnecting substrates of various types in modular assemblies of such apparatus. The substrates may comprise conductive plates, such as bus plates and ground plates, and/or printed circuit boards on which electrical circuits are mounted having conductive terminals formed thereon for connection to power sources. More particularly, the invention relates to a flexible feeding post which provides secure mechanical and electrical interconnection of such substrates, to assure that the abutting contact surfaces of the opposite ends of each feeding post and the contact surfaces of the respective substrates interconnected thereby are in intimate and uniform engagement, to minimize the contact resistance therebetween and thus the voltage drop across the engaged contact surfaces.

2. State of the Prior Art

Modern electronic equipment comprises numerous electrical circuits of varied types which typically are mounted on several substrates, conventionally referred to as printed circuit boards. The electrical circuits are supplied with power through power distribution circuits which likewise may be formed on substrates, such as printed circuit boards, or may comprise conductive plates, known as bus plates and ground plates. FIG. 1 is a simplified, elevational view of a typical, or representative, type of such electronic equipment having modular internal organization and assembly, to which the present invention particularly relates. The modular units may be of various types, and any given module may comprise a number of printed circuit boards on each of which are mounted conventional circuits. Thus, the electronic apparatus 10 may comprise a number of subsystem modules 12, power distribution modules 14 and cooling system modules 16 and 16', the latter comprising air ducts 18 and 18' and cooling fans 20 and 20', respectively. In such a modular assembly, the substrates of each modular unit typically are arranged in parallel relationship with respect to each other, and power is supplied from appropriate power sources (not shown), to the respective circuits of the subsystem modules 12 through associated power distribution modules 14. The individual subsystem modules 12 are connected to the power distribution modules 14 by respectively associated pluralities of feeding posts 22, which are capable of carrying relatively high currents. Typically, the feeding posts 22 are integrally connected to the power distribution modules 14, in positions corresponding to the power input terminals, or contacts, of the printed circuit boards of the subsystem modules 12, such that the latter are received in abutting relationship on the corresponding contact surfaces of the feeding posts 22 and secured thereto, for example by mounting screws, so as to achieve an intimate mechanical connection therebetween having minimum electrical contact resistance and thus to avoid any undesirable voltage drop at the contacting surfaces.

As is well known, there is a stringent requirement of high packing density of the electronic elements in electronic equipment of the type with which the present invention is utilized, such as large capacity computers. The high packing density requires that a large number of circuits be mounted in close proximity on each printed circuit board. This further requires that electrical power of various different voltage levels be supplied to the circuits. Further, to assure that current is distributed uniformly to the various circuits on the printed circuit boards, it is also conventional to employ several feeding posts for distributing electrical power, even of the same voltage level, to the various circuits. As a result, it is necessary to employ a large number of feeding posts for supplying electrical power to the printed circuit boards and thus to the circuits mounted thereon. To achieve high density of the circuits mounted on a given printed circuit board, the power input terminals of each individual printed circuit board to which the feeding posts are connected preferably occupy a minimal portion of the available area of the printed circuit board, and typically are positioned in aligned relationship along the periphery of the printed circuit board. Thus, the feeding posts correspondingly must be of small dimensions and, because of the power supply requirements discussed above, must be accurately positioned to permit proper assembly of the printed circuit boards with the feeding posts.

FIG. 2 is an enlarged and exploded, perspective view of a conventional feeding post 24 which may be used to interconnect a conventional bus plate 26, which may corresond to a power distribution module 14 as seen in FIG. 1, to a corresponding circuit terminal 28 formed on a printed circuit board 30. Connecting holes 32 and 34 are formed in the bus plate 26 and the printed circuit board 30, respectively, in predetermined positions such that they are in aligned relationship when the bus plate 26 and printed circuit board 30 are assembled and interconnected by the feeding post 24. The connecting hole 34, as seen, is formed to pass centrally through the circuit terminal 28. The conventional feeding post 24 comprises a conductive, solid cylindrical stud 36 of height H, which is threaded at its opposite ends to receive corresponding screws 37, 37' each carrying a respective washer 38, 38'. For assembling the printed circuit board 30 and the base plate 26, the stud 36 is disposed therebetween with its opposite, threaded ends in alignment with the connecting holes 32 and 34, such that the screws 37, 37' may be passed through the corresponding holes 34 and 32 and be received in threaded engagement in the corresponding, internally threaded ends of the stud 36 thereby securely interconnecting the printed circuit board 30 and the base plate 26. The distance between the bus plate 1 and the printed circuit board 2 thus is defined by the height H of the cylindrical stud 36.

For the reasons described above, and particularly to satisfy the demand for high packing density of electronic components mounted on the printed circuit boards and the related power supply requirements, there has resulted a significant increase in the number of feeding posts which must be mounted on a bus plate. This contributes to a requirement for maintaining extreme accuracy both as to the height H of the cylindrical stud portion 36 of a feeding post 24, as seen in FIG. 2, and also as to precise axial alignment of the feeding post 24 and the corresponding connecting holes 32 and 34 of the bus plate 25 and the printed circuit board 30, and particularly the terminal 28 of the latter through which the connecting hole 34 passes. Absent precise alignment of these elements, mechanical distortion of the substrates and resultant stress will be produced when the substrates and associated bus plates are assembled and engaged together by the associated feeding posts.

Even if ideal conditions are satisfied in the initial mechanical assembly of the module such that no distortion and resultant stress of the substrates exist, during the subsequent operation of the electrical components, nonuniform thermal expansion of the substrates occurs which introduces mechanical distortion, or deformation, and resultant stresses. This thermal expansion, of course, is caused by the heat generated during the operation of the electrical components, e.g., heat loss from transistors, and produces nonuniform heat distribution resulting in nonuniform thermal expansion of the substrates. Further, since the substrates typically comprise a laminate of layers of different materials having different coefficients of thermal expansion, distortion of the substrates is usually unavoidable in prior art modular assemblies.

The mechanical misalignment, whether existing initially or caused by thermal effects during subsequent operation, results in a non-perpendicular mounting of the contact surfaces of the ends of the feeding posts relative to the contact surfaces of the bus plate 26 and the terminal 28 of the printed circuit board 30, such that the actual contact area of the respective, opposed contact surfaces is reduced. This effect produces an undesirable voltage drop at the interconnection, and as well can result in the generation of heat, due to the increased current density which must be carried by the reduced, common cross-sectional areas of the surfaces which are in contact. There result both adverse effects on the curcuit operation and additional heat generation, with the potential of thermal damage of the interconnecting surfaces and the portions of the substrates in their vicinity.

Thus, in the use of prior art feeding posts, it has been difficult to obtain and maintain good mechanical and electrical contact between the feeding posts and the related substrates which are interconnected thereby, and, more particularly, between the contact surfaces of the feedings posts and the intended, corresponding contact surfaces of the associated substrates, such as the terminals of circuits mounted on a printed circuit board and the surface of the bus plate. The factors contributing to that difficulty in the use of prior art feeding posts are the need to maintain precise alignment of the connecting holes of the substrates and the center line of the current feeding posts, the need to maintain uniform, consistent heights H of the cylindrical stud portion of plural such feeding posts which mechanically and electrically interconnect the associated substrates, and the problems created by thermal effects during operation. These problems are caused, to a significant extent, by the rigidity of the cylindrical stud portion of the prior art connecting posts.

SUMMARY OF THE INVENTION

The present invention is directed to overcoming the problems associated with the use of prior art feeding posts and, particularly, the problems as arise out of the rigidity of such prior art connecting posts, which rigidity contributes to the difficulty of obtaining and maintaining good electrical contact between the respective contact surfaces of such prior art feeding posts and the respective substrates which are interconnected thereby.

More particularly, it is an object of the present invention to provide an improved current feeding post for assembling substrates into a circuit module, which feeding post has a flexible structure affording increased tolerance for dimensional variations between, and misalignment of, the contact surfaces of the substrates to be interconected by the feeding post.

A further object of the present invention is to provide a flexible feeding post which may be handled easily for purposes of assembling circuit modules in a mass production line, thereby to reduce the assembly costs.

Yet another object of the present invention is to provide a flexible feeding post for the assembly of substrates into a circuit module, which increases the quality and reliability of the resultant modular circuit assembly.

Various considerations have been given to possible alternative structures of, and/or techniques relating to, feeding posts to overcome the problems presented by the rigidity of the prior art feeding posts. For example, a feeding post having elastic deformation in its axial direction can be achieved by employing two inter-fitting cylindrical portions, one thereof being received coaxially within the other, in a manner analogous to a shock absorber or a cylinder and a piston of an engine as employed in the automative industry; either a coil spring or a multiple- or single-folded plate spring may be inserted between the two cylinders to resiliently bias same to a desired, and substantially uniform height H, the resilient biasing by the spring in either instance nevertheless affording some degree of axial compression of the individual feeding posts. While such a structure may solve dimensional variations in the required spacing between parallel substrates, and thus the height H of the feeding posts interconnecting same, it is not altogether satisfactory since it affords no tolerance for axial misalignment, whether existing initially or occurring due to deformation effects which alter the initial axial alignment of the mounting holes and the center line of the feeding posts, such as thermal deformation resulting from subsequent electrical operation of the assembled module. Moreover, since the space available for the feeding posts is extremely limited due to the requirement for high packing densities, as above mentioned, such spring-biased dual cylindrical structures are unsuitable since feeding posts of such configurations tend to be of larger size and thus not capable of being accommodated properly in the available space allotted thereto on the substrates. Moreover, such structures have demonstrated lower reliability, in actual use.

The present invention overcomes the problems of the prior art feeding posts by employing a metal bellows as a part of the feeding post, affording both axial and radial flexibility. While a metal bellows structure is more expensive than the coaxial, sliding cylinder structure employing coil springs or folded plate springs, it can be of compact size and balanced symmetrical construction, having both sufficient elasticity and deflection capabilities to afford the requisite tolerances for mechanical misalignment, spacing variations and thermal deformation problems encountered during operation of the electrical circuits, and also sufficient electrical conductivity to pass the requisite high currents without causing local overheating and related thermal deformation during circuit operation. As will be appreciated, feeding posts in accordance with the present invention find particular utility and benefit in a modular assembly requiring a large number of feeding posts.

A feeding post, in accordance with the invention, has a current handling capacity which is determined by the thickness, diameter, and resistivity of the material of the bellows. To satisfy a demand for higher current capacity of the feeding post, there furthermore may be provided in accordance with the invention a flexible, high-level current bypass of highly conductive material, relative to the bellows.

These and other features and advantages of the present invention will be apparent from the following detailed description of the present invention and the claims, taken with reference to the accompanying drawings, wherein like reference numerals designate like parts.

DETAILED DESCRIPTION OF THE PREFERRED EMBODIMENT

Figure 3:
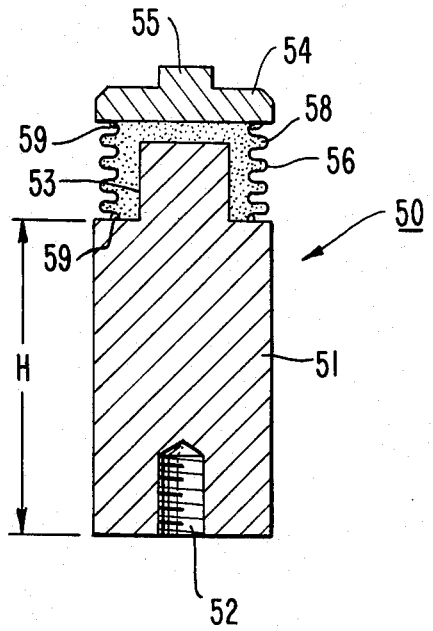
FIG. 3 is a cross-sectional, elevational view of a feeding post in accordance with a first embodiment of the present invention.

The flexible current feeding post of the present invention is shown in a first embodiment thereof in FIG. 3, comprising a cross-sectional elevational view taken generally through the axis of the generally cylindrical structure. Particularly, the feeding post 50 comprises a solid, generally cylindrical stud 51 having a threaded, central axial bore 52 at a lower end thereof and a generally cylindrical extension 53, of reduced diameter relative to the main body of the stud 51, at the upper end thereof, as seen in FIG. 3. The upper end of the feeding post 50 is defined by a generally cylindrical disk 54 having a central, generally cylindrical protrusion 55 of reduced diameter relative to that of the disk 54. The disk 54 is joined to the stud 51 by a flexible, conductive bellows 56. The bellows 56 is formed of a conductive material, as noted, which preferably is metal, such as phosphor-bronze, pure copper, cupro-nickel (a copper-nickel alloy), or stainless steel. As will be appreciated, the bellows 56 defines a normal, central axis with which the stud 51 and the disk 54 are aligned. The bellows is integrally joined at its opposite ends to the disk 54 and the stud 51, suitably by solder joints 59 extending about the periphery of the bellows 56 and the respective, mating surfaces of the disk 54 and the stud 51. The selection of the particular metallic material to be employed is determined by the required, current handling capacity, and the heat or thermal conditions to which the feeding post will be subjected during normal operation. For example, if high current handling capacity is required, copper is suitable. If the feeding post will be subjected to and thus must withstand high temperature heat processing, stainless steel or phosphor-bronze is more appropriate.

To increase the current handling capacity of the feeding post 50 of the invention, a conductive liquid 58 is sealed inside the bellows 56. One example of a conductive liquid is a low melting temperature solder, which is suitable for use when the operating temperature of the feeding post 50 exceeds the melting temperature of the solder. In this embodiment, the material of the bellows 56 must be selected carefully in relation to that of the liquid 58, to avoid erosion or alloying problems, such as may result from molten solder when used as the conductive liquid 58. As will be appreciated, the conductive liquid 58 effectively serves as a bypass for current flow, relative to the bellows 56, thus affording a high current conductive path through which the majority of the required current flows.

Figure 4:
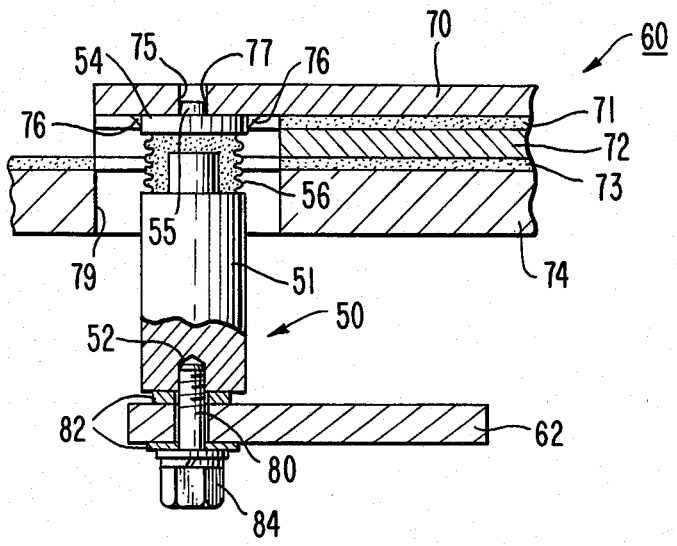
FIG. 4 is a broken-away, elevational view, partly in cross-section, illustrating the assembly of substrates utilizing a feeding post in accordance with FIG. 3.

FIG. 4 is a partially broken-away, elevational view taken partly in cross section, illustrating the connection of two substrates by the feeding post 50 formed in accordance with the embodiment of the invention shown in FIG. 3. More particularly, the feeding post 50 is utilized for mechanically and electrically interconnecting an upper, multi-layer laminant substrate 60 and a lower, single layer substrate 62. The upper multi-layer laminant substrate 60 is configured, in a manner to be described, to receive the contact surface of the upper end of the feeding post 50. More particularly, the upper, multi-layer laminant substrate 60 includes first and second bus plates 70 and 72, which typically may comprise copper plates for power distribution or supply, and an earth- or ground-plate 74, typically of aluminum and of relatively greater thickness so as to serve simultaneously as a main, mechanical support plate providing substantial rigidity to the module. A pair of insulating plates 71 and 73, which may comprise plastic sheets, physically separate and electrically insulate the conductive plates 70 and 72, and the conductive plates 72 and 74, respectively.

In the illustrative, specific connection implemented in the composite structure of FIG. 4, the feeding post 50 electrically interconnects the upper bus plate 70 with terminals 82 on the upper and lower surfaces of the bus plate 62, which may comprise a conventional printed circuit board. For this purpose, the protrusion 55 of the disk 54 is received through a suitable aperture 75 formed in the upper bus plate 70 to provide appropriate alignment of the feeding post 50 therewith. The disk 54 is then soldered about its periphery to the bus plate 70, as shown at 76; if desired, a solder joint also may be formed between the periphery of the protrusion 55 and the interior wall of the aperture 75, as shown at 77. It will be appreciated that in this mounting and interconnection arrangement, a suitable aperture 79 is formed, extending through the insulating plates 71 and 73, the lower bus plate 72 and the ground plate 74, to expose the lower, contact surface of the bus plate 70.

Figure 1:
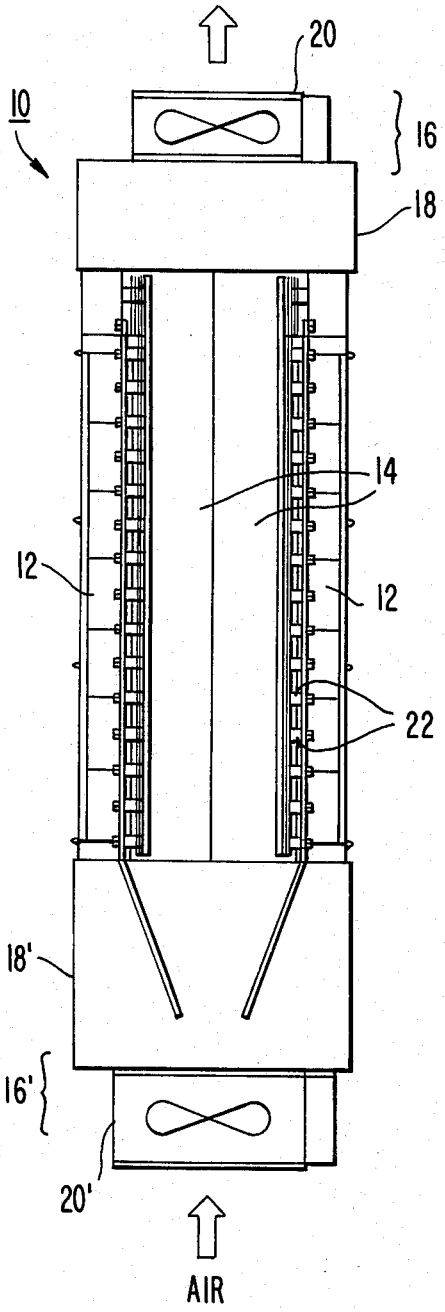
FIG. 1. (PRIOR ART)
FIG. 1 is an elevational, schematic view of a modular assembly of electronic apparatus, indicating the general structural relationship of plural individual modules as assembled therewithin, in accordance with the prior art.
Figure 2:
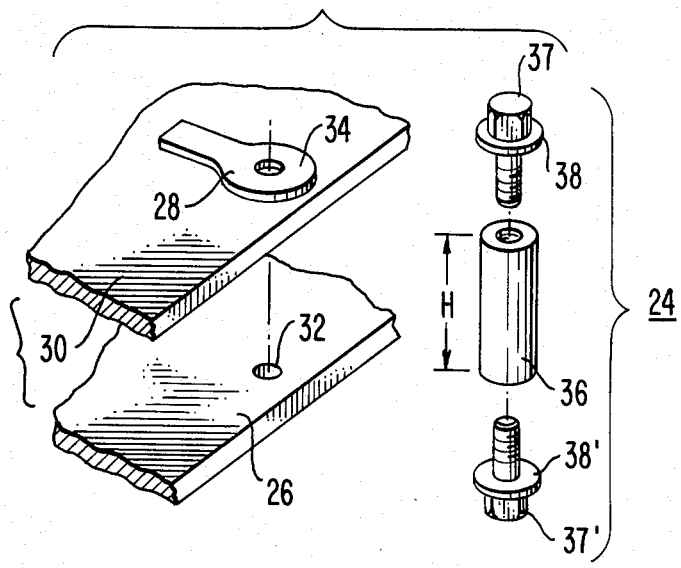
FIG. 2. (PRIOR ART)
FIG. 2 is an exploded, partial perspective view of a typical prior art feeding post and associated substrates having connecting holes, to be interconnected electrically and mechanically by the feeding post.

The lower substrate 62 includes an aperture 80 extending also through the terminals 82, which are illustrated to be provided on both opposite surfaces of the substrate 62 and comprise the contact surfaces thereof, each of which generally may correspond to the terminal 28 formed on the printed circuit board 30 of FIG. 2. The contact surface of the opposite, lower end of the feeding post 50 is secured to the printed circuit board 62 by a screw 84, which is inserted through the aperture 80 and received in threaded engagement within the threaded bore 51 of the feeding post 50.

As will be appreciated, the flexibility of the conductive bellows 56 of the feeding post 50 affords tolerance for a limited extent of misalignment of the centering aperture 75 of the substrate 60 and the mounting aperture 80 of the lower substrate 62, by radial deformation of the bellows 56, relative to its normal, central axis. As likewise will be apparent, the feeding post 50 affords a limited extent of axial extension or compression, thus compensating for any differences in the axial length of plural such feeding posts 50 as may be used to electrically and mechanically interconnect the substrates 60 and 62, as well as for any variations in the desired spacing therebetween as may be caused by structural differences of the substrates themselves, whether initially existing or created by thermal effects in subsequent operation. Accordingly, the exposed contact surfaces of the terminals 82, disposed on opposite sides of the lower substrate 62, are maintained in uniform and intimate contact throughout their abutting surfaces with the screw head 84 and the lower surface of the solid stud 52, respectively, of the feeding post 50, and are mechanically secured together by tightly threaded engagement of screw 84 with the post 52. Elastic deformation of the bellows 56 thus affords uniform surface contact and good electrical connections without undesirable voltage drops, between the contact surfaces at the ends of the feeding post 50 and the corresponding contact surfaces of the respective upper and lower substrates 60 and 62. Thus the flexible feeding post 50 of the invention relaxes the required tolerances both as to axial alignment and as to the spacing height H, in the connection of the associated upper and lower substrates 60 and 62.

As an alternative to the structure illustrated in FIG. 4, a second stud 51 may be similarly joined to the upper end of the bellows 56, as an alternative to the disk 54; conversely, a second disk 54 may be used in the alternative to the stud 51. In either case, the number of different parts requred for the flexible feeding post 50 of the invention is reduced. In some circumstances, the ends of the bellows 56 may be soldered directly to the contact surfaces of the spaced substrates. Likewise, it will be apparent that in any of the foregoing embodiments, each of the disc 54 and the stud 51 may have geometric configuration differing from that shown, the significant factor being the use of the flexible interconnecting bellows 56 and the provision of adequate, rigid means connected thereto at its opposite ends and providing the the desired mechanical and electrical connection to the contact surfaces of the respective, parallel-spaced substrates, such as 60 and 62 in FIG. 4.

Figure 5A:
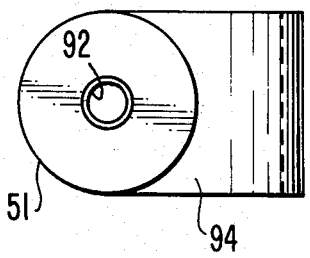
FIGS. 5A and 5B are plan and elevational views, respectively, the latter being broken-away, illustrating a feeding post having an external current bypass element in accordance with the invention.
Figure 5B:
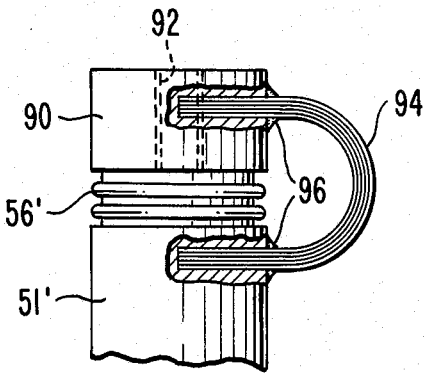

An alternative embodiment of the feeding post of the invention is illustrated in the plan view of FIG. 5A and the broken-away, elevational view of FIG. 5B. The feeding post 50' of FIGS. 5A and 5B retains the basic structure of feeding post 50 of FIG. 3, and thus comprises a lower, cylindrical solid stud 51' and a bellows 56'. However, the post 50' of FIGS. 5A and 5B, rather than employing a flat disk 54 as in FIG. 3, comprises a cylindrical element 90 having a central threaded bore 92 whereby the same may be secured by a screw to an upper substrate, rather than by soldering as in the configuration of FIG. 4. This embodiment, moreover, employs an alternative current bypass for the bellows 56'. Particularly, a flexible thin sheet laminate 94 affords a high current capacity bypass relative to the bellows 56, such as 10 to 50 amperes, and may comprise a laminant of several thin sheets of high conductivity metal, such as copper. The thin sheets of metal or other conductive material affords sufficient flexibility to maintain the function of the bellows 56', while having adequate current capacity to meet the requirements of the flexible post 50'. The laminant conductive bypass structure 94 may be mechancially and electrically secured to the upper cylinder 90 and to the lower stud 51' by conventional soldering, as illustrated at 96, the laminant 94 being suitably configured so as to engage the respective circumferential surfaces of the upper cylinder 90 and the lower stud 51', as best seen in the plan view of FIG. 5A.

Figure 6A:
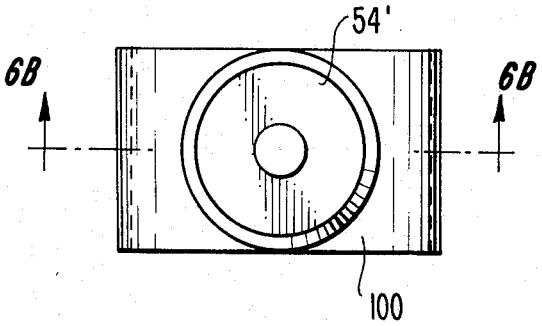
FIG. 6A is a plan view of a feeding post in accordance with yet another embodiment of the invention, employing symmetrical current by-pass elements.
Figure 6B:
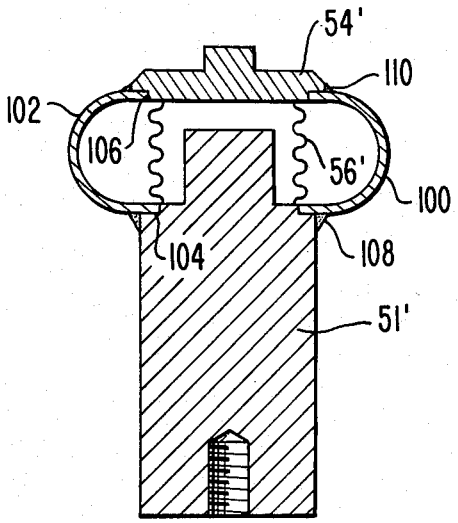
FIG. 6B is an elevational, cross-sectional view taken along the line 6B—6B in FIG. 6A.

FIGS. 6A and 6B are plan and elevational, cross-sectional views, respectively, of yet a further embodiment of the present invention. In this embodiment, symmetrical flexible bypass conductive sheets 100 and 102 interconnect a lower stud 51' and an upper disk 54', which in this instance correspond substantially to the stud 51 and the disk 54, respectively, of FIG. 3. For enhanced mechanical engagement of the bypass sheets 100 and 102, the lower stud 51' may have a receiving circumferential notch formed therein, as shown at 104, and the disk 54' likewise may have a notch 106 formed in its lower surface, thereby to receive the corresponding lower and upper ends of the flexible bypass sheets 100, the latter then being secured to the stud 51' and the disk 54' by solder joints as indicated at 108 and 110, respectively. The bypass 100 may be a thin copper plate configured at its corresponding ends to conform to the cylindrical circumferences of the disk 54' and the stud 51', as generally seen in the plan view of FIG. 6A.

As a further alternative, each of the structures of FIGS. 5A, 5B, and 6A, 6B may include a conductive liquid within the bellows 56'. In the case of the structures of FIGS. 5A and 5B, once a mounting screw is threaded into and thus received in the threaded bore 92, even though the solder within the bellows 56' would become molten at the standard operating temperature of the associated structure, the aperture would necessarily be plugged sufficiently so as to avoid leakage.

Numerous modifications and adaptations of the flexible current feeding post of the present invention will be apparent to those of skill in the art and thus it is intended by the appended claims to cover all such modifications and adaptations which fall within the true spirit and scope of the appended claims.

We claim:

1. A flexible current feeding post for mechanically and electrically interconnecting first and second substrates at respectively corresponding, predetermined contact surfaces thereof, to maintain the substrates in substantially parallel and nominally predetermined, spaced relationship and to feed current from the contact surface of one of said substrates to the contact surface of the other of said substrates, comprising:

a metal post of a first predetermined axial length having first and second ends and defining a central axis, said first end having a coaxial, threaded bore for positioning in alignment with an aperture in a corresponding contact surface of the first substrate, the aligned said aperature and bore being adapted to receive a screw therethrough for rigidly securing said first end of said post to the corresponding contact surface of the first substrate, and said metal post further having a cylindrical extension of a second predetermined axial length extending coaxially from said second end of said post and having a free end;

a conductive, flexible bellows of a nominal third predetermined axial length greater than the second predetermined axial length and having first and second ends, said bellows being received coaxially about said cylindrical extension and secured at said first end thereof to said second end of said metal post, with said second end of said bellows extending beyond said free end of said cylindrical extension by a nominal, predetermined amount corresponding to the difference between the second and third axial lengths;

a solid conductive disc having first and second, generally parallel, spaced planar surfaces disposed transversely to the central axis and coaxially with said bellows, said first planar surface of said disc being secured to said second end of said bellows and displaced thereby from said free end of said extension by the nominal, predetermined amount, and said second planar surface of said disc having a central projection extending coaxially therefrom for being received in an aperture extending through a corresponding contact surface of the second substrate thereby to align said second planar surface of said disc in contacting relationship with the associated contact surface of the second substrate, said second planar surface of said disc being adapted for being bonded to the corresponding contact surface of said second substrate; and the first predetermined length of said metal post, the third, nominal predetermined length of said flexible bellows, and the thickness of said solid conductive disc defined by the spacing of said parallel planar surfaces thereof nominally defining the predetermined, spaced relationship between the first and second substrates.

2. A flexible feeding post as recited in claim 16, wherein the material of said bellows comprises a metal.

3. A flexible current feeding post as recited in claim 1, further comprising current bypass means of flexible, conductive material associated with said conductive flexible bellows, of sufficient conductivity to conduct current between said post and said disc, as a current bypass for said flexible bellows, and of sufficient flexibility so as not to impede the flexibility of said bellows in said axial and radial directions.

4. A flexible current feeding post as recited in claim 3, wherein said flexible, conductive material comprises a low melting temperature metal disposed within said flexible bellows, and which is molten at the normal operating temperature of said flexible current feeding post.

5. A flexible current feeding post as recited in claim 4, wherein said low melting temperature metal comprises solder.

6. A flexible current feeding post as recited in claim 3, wherein said flexible, conductive material comprises a flexible metal plate connected at the first and second ends thereof adjacent the respective said first and second ends of said flexible bellows for providing a current bypass relative to said bellows.

7. A flexible current feeding post as recited in claim 3, wherein said flexible conductive material comprises a laminated layer of thin metal sheets connected at the first and second ends thereof adjacent the respective said first and second ends of said flexible bellows for providing a current bypass relative to said bellows.

8. A flexible current feeding post as recited in claim 1, wherein the material of said flexible bellows is selected from the class consisting of copper, phosphor-bronze, copper-nickel alloy (cupro-nickel metal), and stainless steel.

9. A flexible current feeding post as recited in claim 3, wherein said flexible conductive material comprises copper.

* * * * *

UNITED STATES PATENT AND TRADEMARK OFFICE

CERTIFICATE OF CORRECTION

PATENT NO. : 4,627,677

DATED : Dec. 9, 1986

INVENTOR(S) : Ono et al.

It is certified that error appears in the above-identified patent and that said Letters Patent is hereby corrected as shown below:

Col. 4

Line 9, delete "interconected" and insert --interconnected--.

Signed and Sealed this

Seventeenth Day of March, 1987

*Attest:*

DONALD J. QUIGG

*Attesting Officer*

*Commissioner of Patents and Trademarks*